US005848657A

United States Patent [19]

Flood et al.

[11] Patent Number: 5,848,657

[45] Date of Patent: Dec. 15, 1998

[54] POLYCRYSTALLINE DIAMOND CUTTING ELEMENT

[75] Inventors: Gary Martin Flood, Canal Winchester; David Mark Johnson, Westerville; Friedel Siegfried Knemeyer, Granville; Bradley Earl Williams, Worthington, all of Ohio

[73] Assignee: General Electric Company, Pittsfield, Mass.

[21] Appl. No.: 777,213

[22] Filed: Dec. 27, 1996

[51] Int. Cl.[6] ..... E21B 10/46

[52] U.S. Cl. ..... 175/426; 175/434

[58] Field of Search ..... 175/426, 430, 175/431, 432, 434

[56] References Cited

U.S. PATENT DOCUMENTS

| | | | |
|---|---|---|---|
| 3,136,615 | 6/1964 | Bovenkerk et al. . | |
| 3,141,746 | 7/1964 | De Lai | 51/309 |
| 3,233,988 | 2/1966 | Wentorf, Jr. et al. . | |
| 3,743,489 | 7/1973 | Wentorf, Jr. et al. . | |
| 3,745,623 | 7/1973 | Wentorf, Jr. et al. . | |
| 3,767,371 | 10/1973 | Wentorf, Jr. et al. . | |
| 4,109,737 | 8/1978 | Bovenkerk | 175/430 |
| 4,984,642 | 1/1991 | Renard et al. . | |
| 5,154,245 | 10/1992 | Waldenstrom . | |
| 5,329,854 | 7/1994 | Komstadius et al. | 102/505 |
| 5,374,854 | 12/1994 | Chen | 307/117 |
| 5,486,137 | 1/1996 | Flood et al. | 175/434 X |

FOREIGN PATENT DOCUMENTS

| | | | |
|---|---|---|---|
| 0 322 214 A1 | 6/1989 | European Pat. Off. . | |
| 0 356 097 A2 | 2/1990 | European Pat. Off. . | |
| 9730918810 | 8/1997 | European Pat. Off. . | |
| 1352033 | 11/1987 | U.S.S.R. | 175/426 |
| 2 270 493 | 3/1994 | United Kingdom . | |
| PCT-WO 96 03567 A1 | 2/1996 | WIPO . | |

*Primary Examiner*—William P. Neuder

[57] ABSTRACT

The present invention relates to a novel domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer. The geometry of the diamond cutting element provides control of interfacial stresses and reduces fabrication costs. The diamond cutting element may contain a pattern of ridges or bumps integrally formed in the abrasive layer which ridges are designed to cause high localized stresses in the rock, thus starting a crack. By initiating cracks in localized areas, the crushing action could be performed with less force.

20 Claims, 6 Drawing Sheets

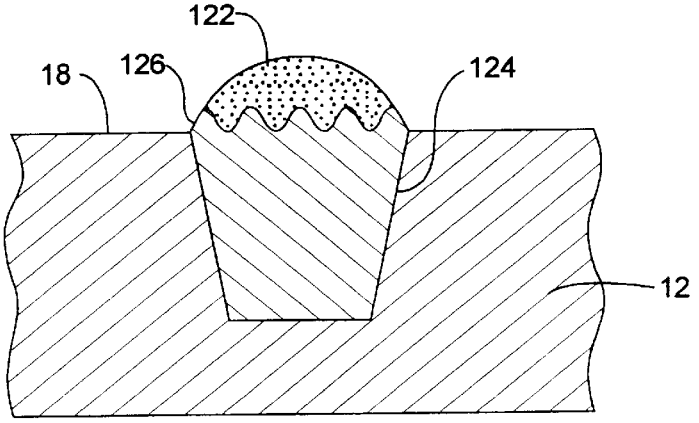
FIG. 13A
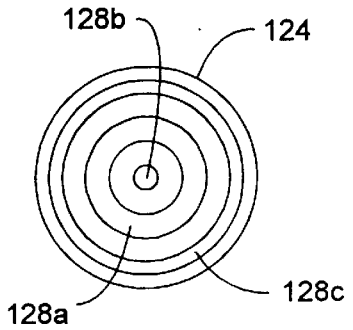
FIG. 13B
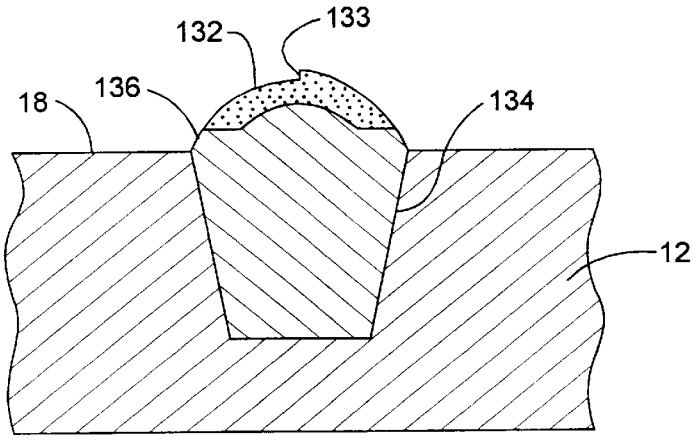
FIG. 14
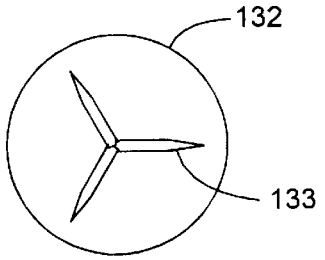
FIG. 15
FIG. 16
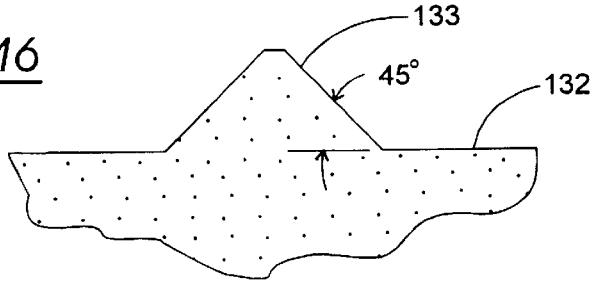

POLYCRYSTALLINE DIAMOND CUTTING ELEMENT

CROSS-REFERENCE TO RELATED APPLICATIONS

This application is cross-referenced to commonly-assigned application Ser. No. 08/645398, filed on Apr. 13, 1996 herewith (attorney docket 60SD-760), entitled "Polycrystalline Diamond Cutting Element With Diamond Ridge Pattern", the disclosure of which is expressly incorporated herein by reference.

STATEMENT REGARDING FEDERALLY SPONSORED RESEARCH

Not applicable.

BACKGROUND OF THE INVENTION

The present invention relates to implements incorporating abrasive particle compacts and more particularly to a novel stud-mounted domed abrasive compact ease of manufacture and novel interface geometry for improved attachment. Such implements have special utility in drill bits for oil and gas exploration and in mining applications.

An abrasive particle compact is a polycrystalline mass of abrasive particles, such as diamond and/or cubic boron nitride, bonded together to form an integral, tough, high-strength mass. Such components can be bonded together in a particle-to-particle self-bonded relationship, by means of a bonding medium disposed between the particles, or by combinations thereof. For example, see U.S. Pat. Nos. 3,136,615, 3,141,746, and 3,233,988. A supported abrasive particle compact, herein termed a composite compact, is an abrasive particle compact which is bonded to a substrate material, such as cemented tungsten carbide. Compacts of this type are described, for example, in U.S. Pat. Nos. 3,743,489, 3,745,623, and 3,767,371. The bond to the support can be formed either during or subsequent to the formation of the abrasive particle compact.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. Particularly, U.S. Pat. Nos. 4,109,737 and 5,374,854, describe drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water cooling or other cooling fluids to the interface between the drill crown and the substance being drilled during drilling operations. Generally, the cutting element comprises an elongated pin of a metal carbide (stud) which may be either sintered or cemented carbide (such as tungsten carbide) with an abrasive particle compact (e.g., polycrystalline diamond) at one end of the pin for form a composite compact.

As disclosed and shown in the prior art, the polycrystalline diamond layer covers the complete cutting surface of the abrasive cutting elements that are employed in a rotary drill, drag, percussion, or machining bits. Rotary drill bits also are known as roller cones. The diamond layer extends to the surface of the drill bit holding the cutting elements. This is shown in U.S. Pat. Nos. 4,109,737 and 5,329,854.

Simply, the diamond layer covers the entire exposed (cutting) surface or radius of the exposed end of the cutting or abrading element.

Unfortunately, in the final machining of these cutting elements, the elements are ground on the outer diameter to very precise tolerances. This grinding can be readily achieved on the tungsten carbide portion of the abrading elements, but when the diamond layer is encountered, maintaining the required tolerances becomes much more difficult. In addition, the grinding means used to machine the cutting elements is easily gouged by the polycrystalline diamond layer. As the grinding means then re-enters the tungsten carbide section of the cutter, these gouges leave undesirable streaks in the finish of the tungsten carbide.

BRIEF SUMMARY OF THE INVENTION

This invention relates to a novel domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer. The geometry of the diamond cutting element provides control of interfacial stresses and reduces fabrication costs.

In another embodiment of the present invention, a pattern of ridges or bumps is integrally formed in the abrasive layer which ridges are designed to cause high localized stresses in the rock, thus starting a crack. By initiating cracks in localized areas, the crushing action could be performed with less force.

BRIEF DESCRIPTION OF THE DRAWINGS

FIG. 13*a* is a cross-sectional view of another embodiment of a cutting element where the substantially flat carbide end with annual sinusoidal grooves as depicted at FIG. 13*b;*

FIG. 14 shows a cross-sectional view of another embodiment of a cutting element where the diamond dome contains a ridge pattern;

FIG. 15 is a top view of the cutting element depicted at FIG. 14;

FIG. 16 is an enlarged view of the ridges depicted at FIG. 15 and 15;

The drawings will be described in detail below.

DETAILED DESCRIPTION OF THE INVENTION

To overcome the finishing problems associated with prior composite compact cutting elements, it has been surprisingly discovered that by undercutting only part of the surface of the substrate of the cutting or abrading element and forming polycrystalline diamond in the undercut surfaces, a cutting element is obtained which when finished, eliminates the problems of finishing associated with prior art abrasion elements. In the practice of this invention, a portion of the carbide substrate to which the polycrystalline diamond is adhered is exposed above the surface of the rotary or machining bit in which it sits. While it was believed that the exposed carbide would wear away during use and, thus, cause fracturing or loss of diamond abrading or cutting surface, it now is expected that this would not occur since the diamond surface of the abrading element absorbs the drilling or machining function without affecting the exposed carbide substrate.

Figure 1:
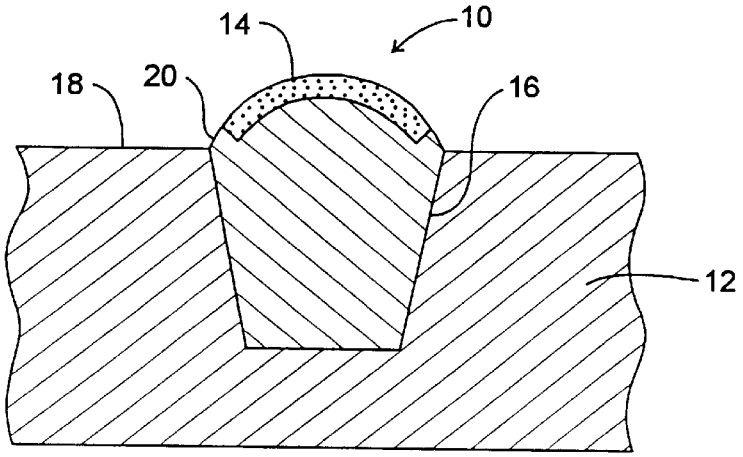
FIG. 1 is a cross-sectional view of a domed cutting element composed of a carbide stud inserted in a drill bit body which stud has a diamond layer dome configured to reveal an annulus of carbide material above the drill body.
Figure 2:
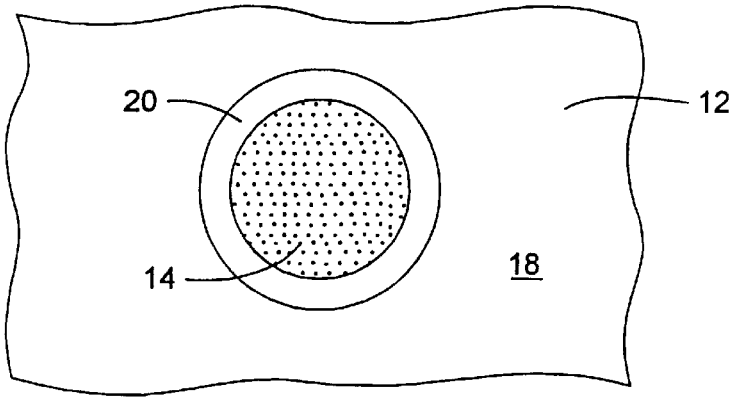
FIG. 2 is a top view of FIG. 1.

Referring initially to FIG. 1, cutting element 10 is shown disposed in drill bit body 12 which is only partially shown. Cutting element 10 is interference fitted into a recess in bit body 12. Cutting element 10 is composed of polycrystalline diamond dome 14 affixed to carbide stud 16. Note, that diamond dome 14 does not cover all of the exposed hemispherical end of stud 16 that extends above outer surface 18 of stud 16, revealing carbide annulus 20. See FIG. 2 in this regard. In the practice of the present invention, a critical and surprising feature is the exposure of a portion of the carbide substrate above the surface of the holder of the abrading or cutting element which substantially reduces finishing costs while reducing the incidences of defects in the diamond dome caused by conventional finishing operations, without expected degradation in cutting performance of cutting life of the novel cutting elements.

As shown on the drawings, the surface of the polycrystalline diamond layer may be domed, hemispherical, hemispherical of reduced radius or hemispherical with a series of flats formed thereon. The interface between the diamond dome and the carbide support stud similarly can take on a variety of configurations for improving the attachment between the diamond layer and the carbide support.

Figure 3:
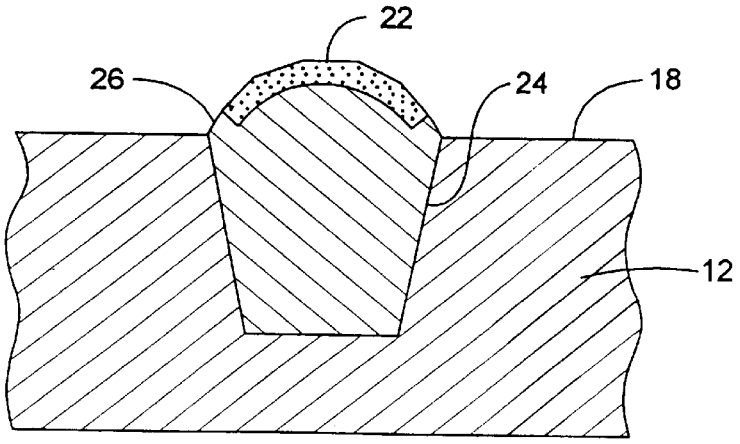
FIG. 3 is a cross-sectional view of another embodiment of a cutting element where the diamond dome has flats.

Referring next to FIG. 3, it will be observed that diamond dome 22 attached to carbide pin or stud 24 contains annual flats rather than being hemispherically smooth. Carbide annulus 26 still is present. For present purposes, "hemispherical" includes hemispherical configurations that have a smooth as well as irregular outer surface.

Figure 4:
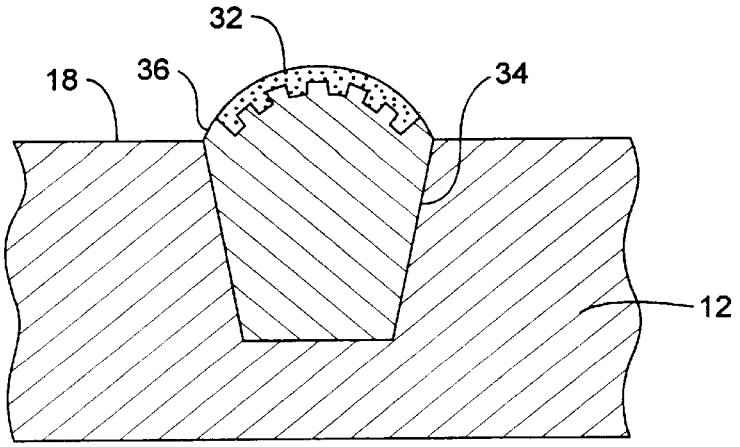
FIG. 4 is a cross-sectional view of another embodiment of a cutting element where the diamond dome-carbide stud interface has a square saw-tooth configuration.

In FIG. 4, diamond dome 32 is attached to carbide stud 34 revealing carbide annulus 36. The outer end of stud 34 bears square grooves for improving the attachment of diamond dome 32 thereto.

Figure 5:
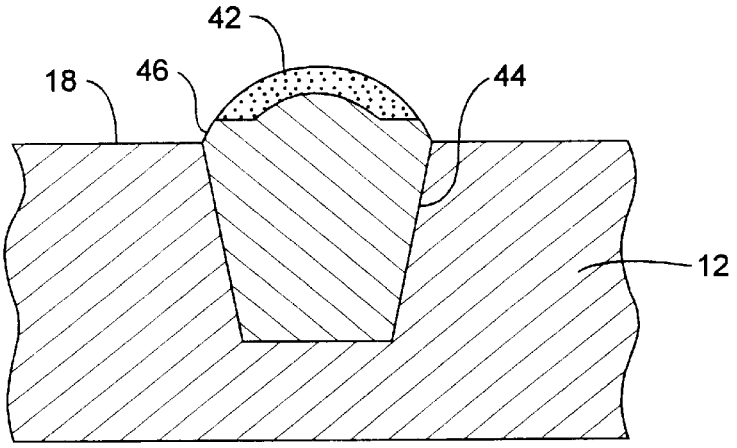
FIG. 5 is a cross-sectional view of another embodiment of a cutting element where the out interface between the diamond dome and the carbide stud is flat.

In FIG. 5, diamond dome 42 is attached to carbide stud 44 revealing carbide annulus 46. In this configuration, however, the outer attachment area between diamond dome 42 and carbide 44 is flat (flat annulus).

Figure 6:
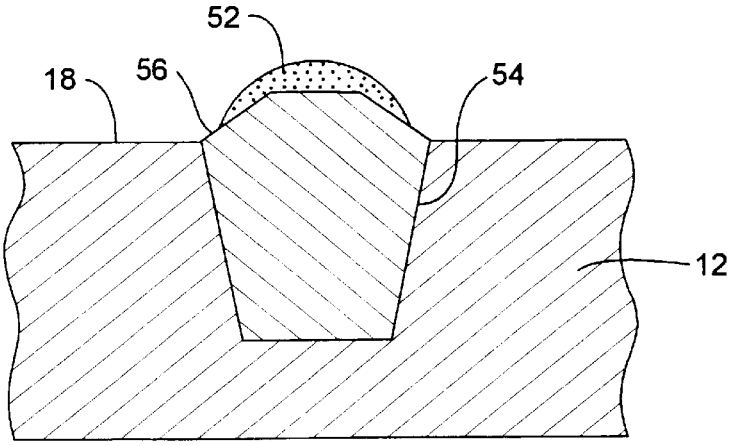
FIG. 6 is a cross-sectional view of another embodiment of a cutting element where the carbide hemispherical end has flats to which the diamond dome is bonded.

In FIG. 6, the outer end of carbide stud 54 is flat on top with an outer flat annulus. Diamond dome 52 is attached to such flats revealing carbide annulus 56.

Figure 7:
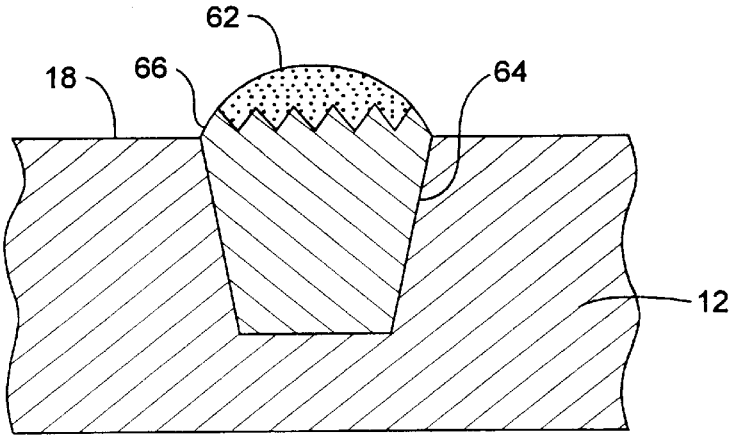
FIG. 7 is a cross-sectional view of another embodiment of a cutting element where the diamond dome-carbide interface is saw-tooth in configuration with the interface sloping upward at the edge.

In FIG. 7, a substantially plane saw-tooth end of carbide pin 64 forms the interface between it and diamond dome 62 wherein the carbide slopes upwardly away from drill body 12 at its interface with diamond dome 62. Carbide annulus 66 still is present.

Figure 8:
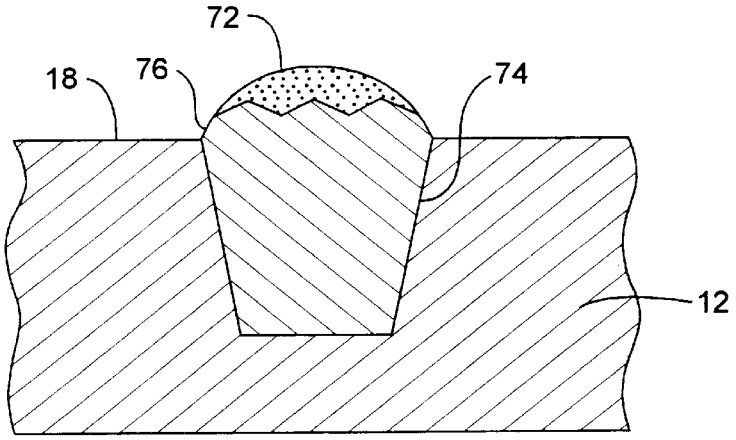
FIG. 8 is a cross-sectional view of another embodiment of a cutting element where the diamond dome-carbide interface is saw-tooth in configuration with the interface sloping downward at the edge.

In FIG. 8, a substantially plane saw-tooth end of carbide pin 64 forms the interface between it and diamond dome 62 wherein the carbide slopes downwardly towards from drill body 12 at its interface with diamond dome 62. Carbide annulus 66 still is present.

Figure 9:
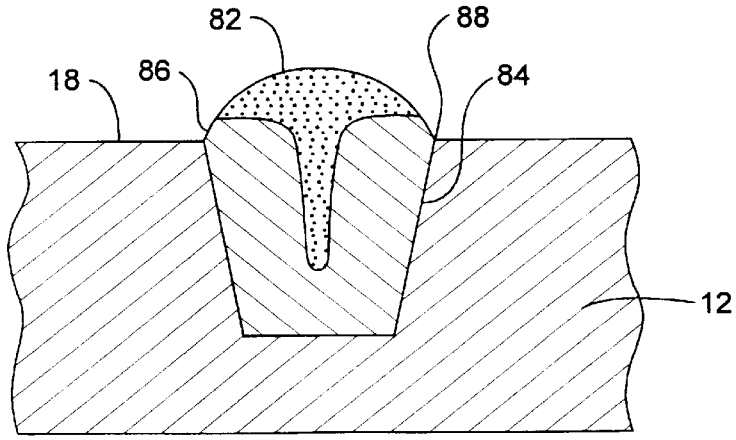
FIG. 9 is a cross-sectional view of another embodiment of a cutting element where the diamond dome has a pillar that extends down into the center of the carbide stud.

In FIG. 9, diamond dome 82 has pillar 88 that extends into carbide stud 84. Carbide annulus 86 still is revealed. Note, that pillar 88 may be formed from coarser diamond grit than the remainder of diamond dome 82.

Figure 10A:
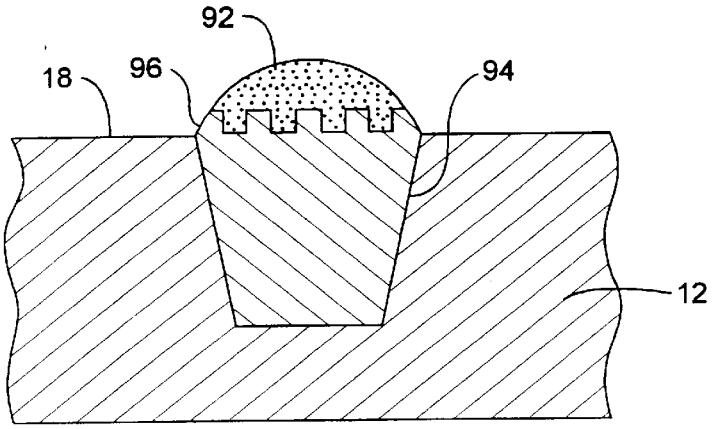
FIG. 10*a* is a cross-sectional view of another embodiment of a cutting element where the substantially flat carbide end with square grooves extending across such end as depicted at FIG. 10*b;*
Figure 10B:
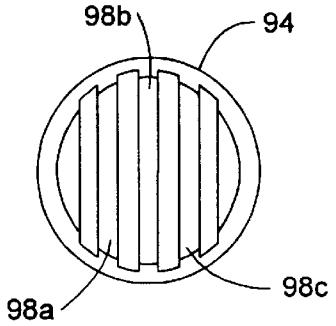

In FIG. 10*a,* carbide stud 94 contains square grooves 98*a–d* (see FIG. 10*b*) across its substantially flat outer surface for improving attachment to diamond dome 92. Carbide annulus 96 still is present.

Figure 11A:
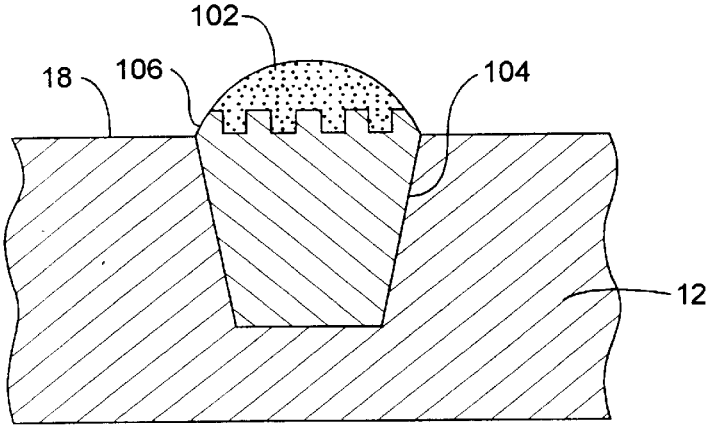
FIG. 11*a* is a cross-sectional view of another embodiment of a cutting element where the substantially flat carbide end with square annual groves as depicted at FIG. 11*b;*
Figure 11B:
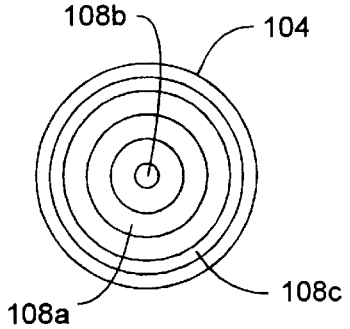

In FIG. 11*a,* carbide stud 104 contains annular square grooves 108*a–b* (see FIG. 11*b*) across its substantially flat outer surface for improving attachment to diamond dome 102. Carbide annulus 106 still is present.

Figure 12A:
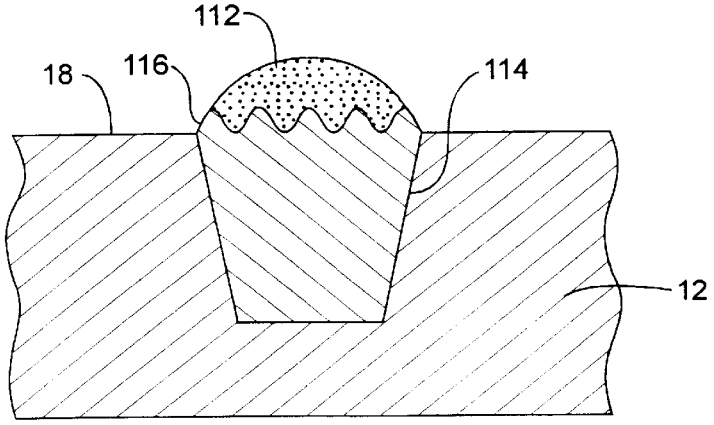
FIG. 12*a* is a cross-sectional view of another embodiment of a cutting element where the substantially flat carbide end with sinusoidal grooves extending across such end as depicted at FIG. 12*b;*
Figure 12B:
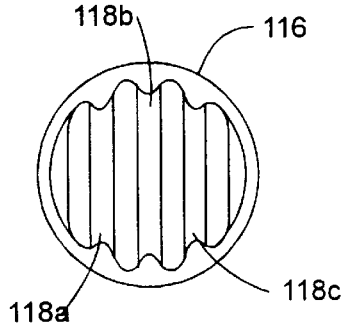

In FIG. 12*a,* carbide stud 114 contains sinusoidal grooves 118*a–d* (see FIG. 12*b*) across its substantially flat outer surface for improving attachment to diamond dome 112. Carbide annulus 116 still is present.

In FIG. 13*a,* carbide stud 124 contains sinusoidal annular grooves 128*a–b* (see FIG. 13*b*) across its substantially flat outer surface for improving attachment to diamond dome 122. Carbide annulus 126 still is present.

In FIGS. 14–19, there is depicted a variation of the abrasive structure involving the formation of a pattern of ridges or bumps integrally formed in the abrasive layer which ridges as disclosed in commonly assigned application Ser. No. 08/645,398, cross-referenced above. These ridges are designed to cause high localized stresses in the rock, thus starting a crack. By initiating cracks in localized areas, the crushing action could be performed with less force. It also can be envisioned how larger cracks also may result in larger chips. Such action, by its very nature, would indicate better cutting efficiencies since the rock-to-rock bond breakage per volume of rock removed decreases.

Figure 17:
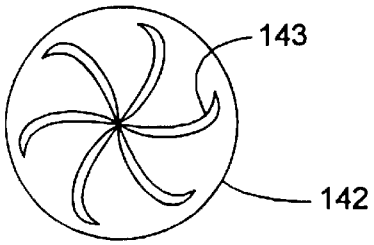
FIG. 17 is a top view of another ridge pattern like that depicted at FIG. 15.
Figure 18:
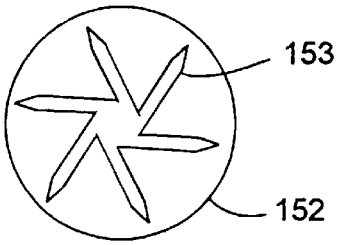
FIG. 18 is a top view of yet another ridge pattern like that depicted at FIG. 15.
Figure 19:
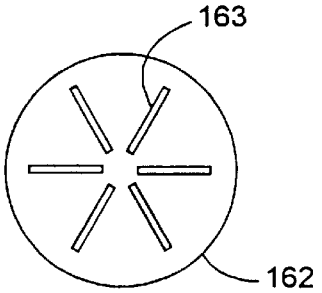
FIG. 19 is a top view of a further ridge pattern like that depicted at FIG. 15.

Referring specifically to FIG. 14, abrasive dome 132 is seen to bear ridge 133 which is part of a spoked pattern as depicted at FIG. 15. Carbide annulus 136 still is present for carbide stud 134. A radial cross-section of ridge 133 is seen at FIG. 16. It is preferred that ridge 133 have an angle of 45° with respect to dome 132. The placement and pattern of the ridges will be determined by the specific application. Additional ridge patterns 143, 153, and 163 formed into abrasive domes 142, 152, and 162, respectively, are depicted at FIGS. 17, 18, and 19, respectively.

Figure 20:
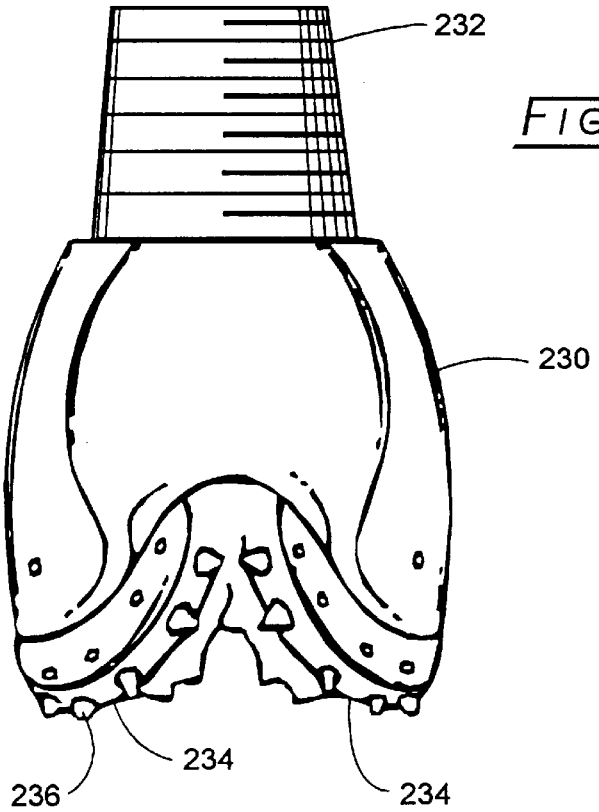
FIG. 20 is a side elevational view of an improved roller-cone drill bit employing the novel cutting elements of the present invention.

FIG. 20 depicts a conventional roller cone drill bit composed of metal drill body 230 having threaded end 232 and three cutter cones 234 (thus, a tricone roller bit, as it sometimes in known in the field). Each cutter cone retains a plurality of cutter elements, cutting element 236 labeled for reference. Such cutting elements are those novel cutting elements of the present invention.

The polycrystalline dome layer preferably is polycrystalline diamond (PCD). However, other materials that are included within the scope of this invention are synthetic and natural diamond, cubic boron nitride (CBN), wurtzite boron nitride, combinations thereof, and like materials. Polycrystalline diamond is the preferred polycrystalline layer. The cemented metal carbide substrate is conventional in composition and, thus, may be include any of the Group IVB, VB, or VIB metals, which are pressed and sintered in the presence of a binder of cobalt, nickel or iron, or alloys thereof. The preferred metal carbide is tungsten carbide.

Further, in the practice of this invention, while the surface configuration of the diamond layer is not critical, it is preferred that the layer be essentially hemispherical. It is also preferred that the surface of the carbide substrate be undercut or pre-formed with an undercut such that the diamond layer is formed in the undercut portion of the carbide substrate.

The surface configuration of the diamond layer may also be conical, reduced or increased radius, chisel, or non-axisymmetric in shape. In general, all forms of tungsten carbide inserts used in the drilling industry may be enhanced by the addition of a diamond layer, and further improved by the current invention through elimination of diamond in part of the exposed outer diameter of the finishing cutting element when inserted in a bit.

Further, the interface between the carbide and diamond layer may be of generally any configuration such as domed, hemispherical, reduced radius, flat, cone-shaped, etc. The interface may also be smooth, serrated, or the like. However, an irregular interfacial surface is preferred since it provides better bonding between the diamond layer and carbide substrate particularly during sintering of the carbide substrate and forming of the diamond layer. Also, the surface of the metal substrate is preferably undercut as shown in the drawings.

As stated previously, an important feature of the present invention is that part of the carbide substrate of the cutting element protrudes above the surface of the tool in which the cutting element is inserted, generally by interference fitting. The unexpected benefits obtained during finishing operations are substantial. Concomitant therewith is the unexpected lack of deleterious consequences that would have been expected by virtue of the carbide annulus being exposed in the cutting area above the bit body.

While the invention has been described and illustrated in connection with certain preferred embodiments thereof, it will be apparent to those skilled in the art that the invention is not limited thereto. Accordingly, it is intended that the appended claims cover all modifications which are within the spirit and scope of this invention. All references cited herein are expressly incorporated herein by reference.

We claim:

1. A cutting element which comprises:

(a) a metal carbide stud having a proximal end adapted to be placed into a drill bit and having a distal end portion; and (b) a layer of cutting polycrystalline abrasive material disposed over said distal end portion such that an annulus of metal carbide adjacent and above said drill bit is not covered by said abrasive material layer.

2. The cutting element of claim 1, wherein said polycrystalline abrasive material is polycrystalline diamond.

3. The cutting element of claim 1, wherein said metal carbide is tungsten carbide.

4. The cutting element of claim 1, wherein the interface between the metal carbide stud and the polycrystalline abrasive material is non-planar.

5. The cutting element of claim 4, wherein the interface between the metal carbide stud and the polycrystalline abrasive material is serrated.

6. The cutting element of claim 5, wherein the serrated interface is linear.

7. The cutting element of claim 5, wherein the serrated interface is annular.

8. The cutting element of claim 4, wherein the outermost interface intersection slopes upward away from the drill bit.

9. The cutting element of claim 4, wherein the outermost interface intersection slopes downward towards the drill bit.

10. The cutting element of claim 4, wherein a polycrystalline abrasive material pillar extends downward into the center of said metal carbide stud.

11. The cutting element of claim 1, wherein the polycrystalline abrasive layer is essentially hemispherical.

12. The cutting element of claim 1, wherein said metal carbide stud is selected from the group consisting essentially of Group IVB, Group VB, and Group VIB metal carbides, and the polycrystalline abrasive material is selected from the group consisting essentially of diamond, cubic boron nitride, wurtzite boron nitride, and combinations thereof.

13. The cutting element of claim 1, wherein said layer of polycrystalline abrasive material bears a pattern of raised ridges.

14. In a drill bit of an elongate drill bit body having recesses for retaining cutting elements, the improvement which comprises said cutting elements comprising:

(a) a metal carbide stud having a proximal end placed into the recesses of said drill bit body and having a distal end portion; and (b) a layer of cutting polycrystalline abrasive material disposed over said distal end portion such that an annulus of metal carbide adjacent and above said drill bit is not covered by said abrasive material layer.

15. The improved drill bit of claim 14, wherein the polycrystalline abrasive is diamond.

16. The improved drill bit of claim 14, wherein the polycrystalline abrasive is cubic boron nitride.

17. The improved drill bit of claim 14, wherein the drill bit is a rotary drill bit.

18. The improved drill bit of claim 14 wherein the polycrystalline abrasive layer of the cutting element is essentially hemispherical.

19. The improved drill bit of claim 14, wherein the interface between the metal carbide stud and the polycrystalline abrasive material is non-planar.

20. The improved drill bit of claim 14, wherein said layer of polycrystalline abrasive material bears a pattern of raised ridges.

* * * * *